United States Patent [19]

VanderMey

[11] 4,117,929

[45] Oct. 3, 1978

[54] SHIPPING UNIT AND METHOD OF LOADING SAME

[75] Inventor: Donald M. VanderMey, Grand Rapids, Mich.

[73] Assignee: Packaging Corporation of America, Evanston, Ill.

[21] Appl. No.: 767,408

[22] Filed: Feb. 10, 1977

Related U.S. Application Data

[63] Continuation of Ser. No. 634,871, Nov. 24, 1975, abandoned.

[51] Int. Cl.[2] ..... B65D 81/02; B65D 85/30; B65D 25/10

[52] U.S. Cl. ..... 206/326; 206/592; 220/416

[58] Field of Search ..... 206/326, 320, 449, 453, 206/448, 521, 592, 591; 229/14 C, 14 R, 17 B, 37 R, 87 R, DIG. 3

[56] References Cited

U.S. PATENT DOCUMENTS

| | | | |
|---|---|---|---|
| 1,841,025 | 1/1932 | Gomes | 229/14 C |
| 2,272,884 | 2/1942 | Zimmerman | 206/453 |
| 2,676,746 | 4/1954 | Kellogg et al. | 229/17 B |
| 2,746,666 | 5/1956 | Riley | 206/320 |
| 2,783,930 | 3/1957 | Riley | 206/320 |
| 3,356,209 | 12/1967 | Pezely, Jr. | 229/14 C |
| 3,727,827 | 4/1973 | Stice | 229/37 R |
| 3,992,849 | 11/1976 | Lett | 206/326 |

*Primary Examiner*—William T. Dixson, Jr.

*Attorney, Agent, or Firm*—Neuman, Williams, Anderson & Olson

[57] ABSTRACT

A shipping unit is provided for accommodating a product, such as table, chest or the like, in an upright position within a foldable container of variable height. The upper portions of the side walls of the container are provided with a plurality of vertically spaced substantially parallel foldlines. Top closure flaps are provided at the upper portions of the container side walls and are foldable relative to the side walls into overlying relation about corresponding selected foldlines. A spacer means is positioned in sandwiched relation between the folded closure flaps and the product upper surface. The spacer means includes a base member having a peripheral configuration corresponding to the area delimited by the side walls of the container. Depending from the base member and affixed thereto are a plurality of retainer elements which snugly engage in encompassing relation peripheral segments of the upper surface of the accommodated product.

3 Claims, 11 Drawing Figures

SHIPPING UNIT AND METHOD OF LOADING SAME

This is a continuation of application Ser. No. 634,871 filed Nov. 24, 1975, now abandoned.

BACKGROUND OF THE INVENTION

In various industries, such as the manufacturing of furniture, the packaging and shipping of the product oftentimes becomes difficult and time-consuming, and involves costly procedures requiring an inordinate amount of labor, a large inventory of various size and types of packaging components dimensioned to accommodate only a specific model product and a large work space in which to carry out the packaging procedure. Furthermore, prior packaging procedures frequently required the talents of skilled carpenters or one possessed of a high degree of dexterity so as to insure the proper protection of the packaged product. Oftentimes in packaging of this type, the components comprising the package added significantly to the bulk and weight of the package, thereby increasing materially the shipping costs. Furthermore, in order to meet strict packaging regulations, it was deemed necessary that inner packaging elements be snugly disposed between the exterior of the packaged product and the walls of the container.

In plants manufacturing custom-type furniture, such as end tables, chests and the like, a particular piece is normally manufactured on an intermittent basis and in a limited number, as opposed to a standard item which is manufactured in large numbers on a continuous or substantially continuous basis. Thus, in a custom furniture manufacturing operation, it has heretofore either required the manufacturer to inventory an extensive variety of packaging components, or in the alternative to order from an outside supplier the components on a piece-meal basis and then coordinate the delivery of such components with the manufacturing schedule of a particular product. The shortcomings of either of these practices are readily apparent.

SUMMARY OF THE INVENTION

Thus, it is an object of this invention to provide a shipping unit capable of effectively packaging individually a wide variety of furniture pieces, while at the same time utilizing a minimum number of components which are of a standardized configuration.

It is a further object of the invention to provide a method of packaging a product which is simple, expeditious and does not require the talents of a skilled person or one possessed of an inordinate amount of dexterity.

It is a still further object of the invention to provide a shipping unit which gives optimum protection for the accommodated product and yet does not add materially to the weight of the packaged product. It is a still further object of the invention to provide a shipping unit wherein the stability of the product within the interior of the container is effectively maintained without requiring the inner packing elements of the unit to be wedged between the exterior of the product and the walls of the container.

Further and additional objects will appear from the description, accompanying drawings and appended claims.

In accordance with one embodiment of the invention, a shipping unit is provided which is adapted to accommodate a product in an upright position within a container. The container has a closed bottom, foldably connected side walls, and top closure flaps connected to the upper portions of the side walls. The upper portion of each side wall is provided with a plurality of vertically spaced substantially parallel foldlines. The top closure flaps are folded relative to the container side walls about the corresponding selected foldlines. Prior to the closure flaps being folded relative to the container side walls into a top closing relation, the upper surface of the accommodated product is overlaid by a spacer means, which includes a base member having a plurality of symmetrically arranged retainer elements affixed to the underside of the base member. The base member has a peripheral configuration which closely approximates the area delimited by the container side walls and, thus, once the base member is positioned within the container, it will be restrained from lateral movement by the container side walls. The retainer elements affixed to the underside of the base member are provided with depending portions which encompass the upper surface of the product and snugly engage peripheral segments thereof. The selected foldlines, about which the top closure flaps are folded, are disposed in close proximity to the upper side of the base member of the spacer means.

DESCRIPTION

For a more complete understanding of the invention, reference is made to the drawings wherein FIG. 1 is a top plan view of one form of blank for a container, the latter comprising one component of the shipping unit.

Figure 8:
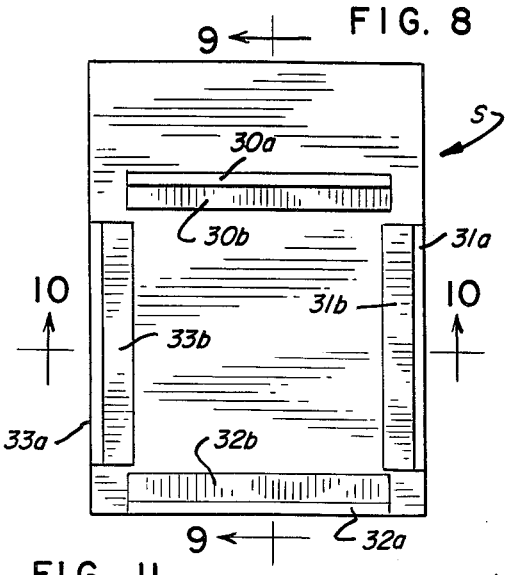
FIG. 8 is a bottom plan view of the spacer means shown in FIG. 4.
Figure 9:
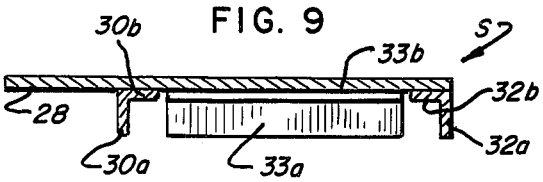
Figure 10:
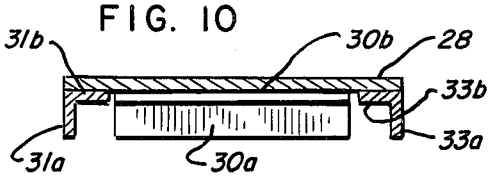

FIGS. 9 and 10 are sectional views taken along lines 9—9 and 10—10, respectively, of FIG. 8.

Figure 11:
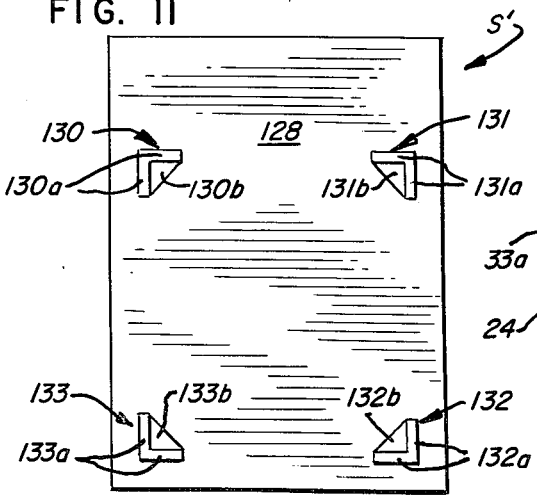
Figure 7:
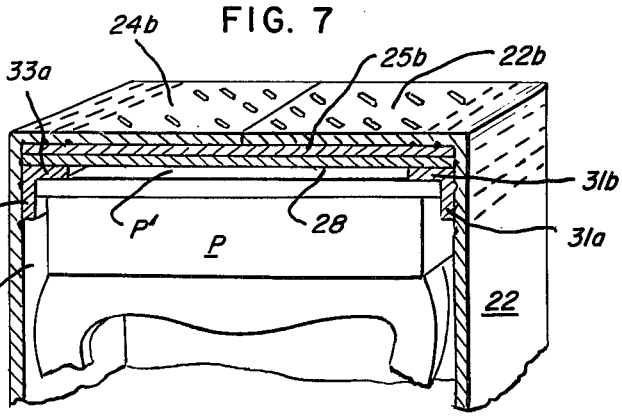
FIG. 7 is an enlarged fragmentary perspective sectional view taken along line 7—7 of FIG. 6.

FIG. 11 is similar to FIG. 8 but showing a modified form of spacer means.

Referring now to FIGS. 4–7, one form of an improved shipping unit 20 is shown which is particularly suitable for packaging furniture products, such as occasional tables, chests, etc. Products of this type require careful handling during packaging, storage and/or shipping so as to prevent marring or defacing of the finished surface. Because such products are normally of custom design and quality, a particular item is not generally mass produced in large numbers on a continuous basis and, thus, in the past it has been necessary for the furniture manufacturer to either maintain a large inventory of packaging components which are uniquely designed for a particular furniture piece, or to purchase frequently a limited quantity of such components which would be required to package a given run of a particular furniture piece. Under the first mentioned practice, the manufacturer could avail itself of price discounts resulting from the purchasing at one time a large quantity of a particular component designed for use with a particular item. Offsetting this advantage, however, was the serious problem of avoiding an inordinate amount of space necessary to house such an inventory, and secondly, the problem of obsolescence of such an inventory in the event the style, size and/or shape of the furniture piece was changed.

On the other hand, where the furniture manufacturer gears its purchasing of the packaging components to coincide substantially to the limited production run of a given furniture piece, the aforenoted problems associated with maintaining a large inventory of packaging components were overcome; however, equally serious logistic and scheduling problems arose and the purchase price of the components was inordinately high.

The instant invention is directed towards retaining and combining the advantages of the above practices without being beset with the shortcomings associated therewith. These attributes of the instant invention will become apparent from the description hereinafter of the improved shipping unit 20 and the method of packaging a product therein. While the description to follow relates primarily to a product such as a small chest or occasional table, it is to be understood, of course, that the invention is not intended to be limited thereto, as the improved shipping unit may be utilized with other products having similar basic characteristics; such as, the exposed surface of the product is susceptible to defacement, the product has a substantially flat upper surface, and the dimensions of the product vary within a limited or well defined range.

Figure 4:
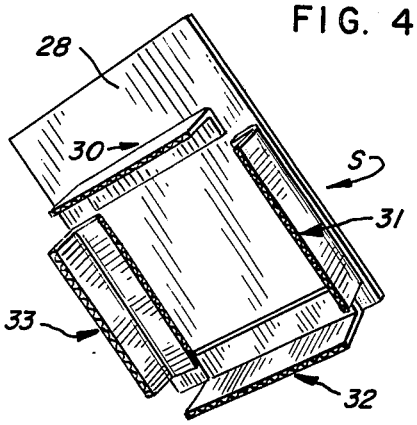
FIG. 4 is a perspective bottom view of one form of the spacer means.
Figure 5:
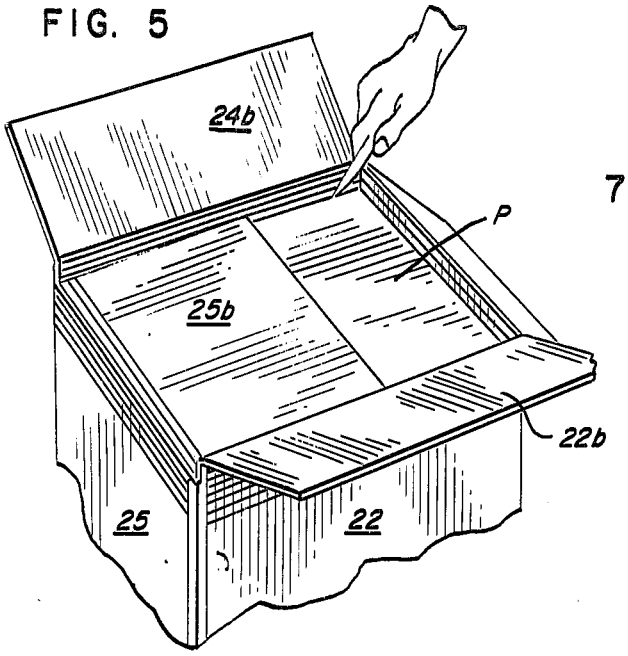
FIG. 5 is an enlarged fragmentary perspective top view of the container showing the spacer means in proper position therein and with one top closure flap folded into overlapping relation with respect to the spacer means.
Figure 6:
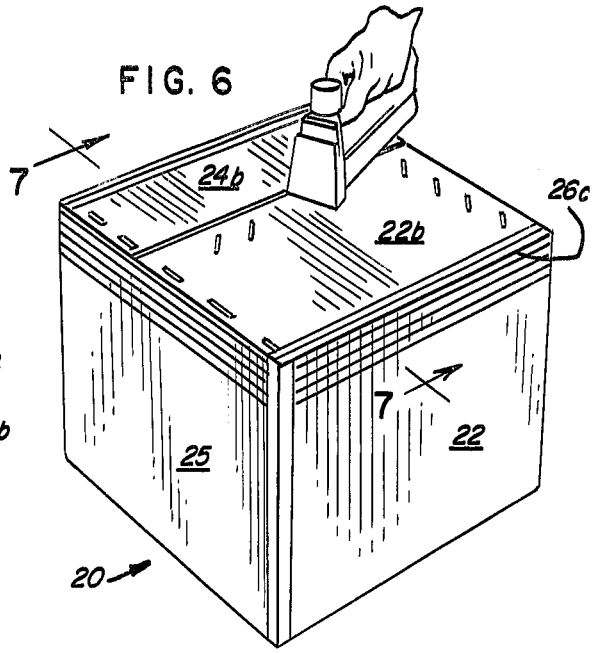
FIG. 6 is similar to FIG. 5 but showing all the top closure flaps in folded relation and secured in place by suitable fasteners.

Basically, the improved shipping unit 20 comprises two components, namely, a container C in which the product P in question is placed, and a spacer means S, or insert piece, which is positioned over the upper surface P' of the accommodated product, see FIGS. 4 and 5, prior to the container being closed for shipping or storage, see FIG. 6. Both components C and S are preferably formed of suitable corrugated medium. The grade or type of corrugated medium to be used in the shipping unit will depend upon the type and size of the product being packaged and the regulations and rules associated with shipment of the unit via railroad, motor carrier, air cargo and/or parcel post.

Figure 1:
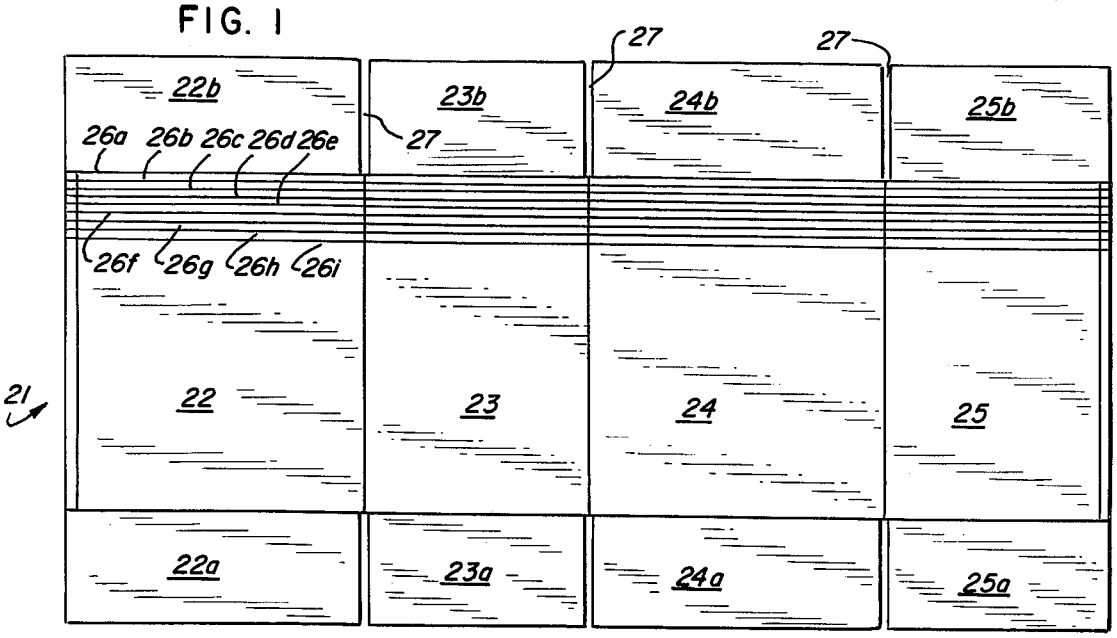

A blank 21 for one form of a standardized container C is shown in FIG. 1 and comprises four foldably connected side walls 22, 23, 24 and 25 which, when the blank is set up, are adapted to encompass the accommodated product P. The endmost side walls 22 and 25 are foldably connected to one another in a conventional way by means of taping, stitching, stapling or gluing. Where stitching, stapling or gluing is employed, a flap, not shown, may be connected to the elongated edge of one of the side walls 22 or 25. Foldably connected to the lower edge of each side wall is a bottom closure flap 22*a*, 23*a*, 24*a* and 25*a* which coact in a conventional way to form a closed bottom when the blank is set up.

Foldably connected to the upper edge of each side wall is a top closure flap 22*b*, 23*b*, 24*b* and 25*b*. Instead of a single foldline being provided for the top closure flap, as is the case with the lower closure flap, the upper portion of each side wall is provided with a plurality or set of foldlines 26*a–i*. The foldlines comprising each set are arranged in vertically spaced relation and are disposed in substantially parallel relation. Each foldline of the set is coextensive with the width of the side wall and is disposed transversely with respect to the foldline connecting adjacent side walls.

It will be noted in FIG. 1 that adjacent top closure flaps are separated from one another by conventional cuts 27 which terminate at the uppermost foldline 26*a*. The purpose of the plurality of foldlines is to enable the height of the container to be varied in accordance with the height of the product being accommodated within the container, as will be described more fully hereinafter.

The spacer means S, as illustrated in FIGS. 4 and 8–10, comprises a base member 28 which is preferably planar and has a peripheral configuration substantially the same as the area delimited by the side walls of the container C. Affixed to the underside of base member 28 by suitable means and arranged in a predetermined pattern thereon are a plurality of retainer elements 30, 31, 32 and 33. The arrangement pattern of the retainer elements is such that the upper surface P' of the accommodated product P will be encompassed thereby when the spacer means S is placed in overlying relation with the surface P', see FIG. 5. Each retainer element is preferably of like configuration and, thus, only element 30 will be described in detail.

Element 30 is provided with a pair of elongated flange portions 30*a* and *b* disposed at a right angle to one another and joined together along a common edge. Portion 30*a* depends from the underside of base member 28 and is adapted to snugly engage a peripheral segment of the product upper surface P', when the spacer means assumes its proper position within the container. Preferably, in the illustrated embodiment portions 31*a*, 32*a* and 33*a* shall each have a substantial thickness so as to provide a substantial clearance between a side of the product and the adjacent side wall of the container. To attain the desired thickness, two or more thicknesses of double-faced corrugated fiberboard may be used. In the spacer means illustrated in FIGS. 4 and 5, it will be noted that the retainer elements 31–33 are disposed at the periphery of the base member 28. The location of these retainer elements is determined by the size and shape of the product upper surface P' relative to the area delimited by the container side walls and the relative location of the upper surface P' within the said area.

Flange portion 30*b* is normally of the same thickness as portion 30*a* and is suitably secured to the underside of base member 28. Thus, when the spacer means is in place, the flange portion 30*b* will be in contact with the product upper surface P'. Thus, in the illustrated embodiment, the product upper surface P' will be spaced from the underside of base member 28 by an amount equal to the thickness of the portions 30*b*, 31*b*, 32*b* and 33*b*. The length of the retainer elements may vary from that shown and their lengths may be unequal, if desired. When the spacer means S is in place, the depending portions of the retainer elements will snugly embrace the periphery of the product upper surface and thereby prevent lateral shifting of the product within the container interior. It is a preferred practice to center the product along one side wall of the container so as to attain reasonable weight balance of the shipping unit.

A modified form of spacer means S' is shown in FIG. 11 wherein triangularly shaped retainer elements 130, 131, 132 and 133 are substituted for the elongated angle shaped elements of the spacer means S, shown in FIG.

8. The location of elements 130–133 corresponds to the location of selected corners of the upper surface of the accommodated product. It should be noted in FIG. 11 that all of the elements 130–133 are spaced inwardly from the periphery of the base member 128, so that the upper surface of the product will be spaced from the side walls of the container a greater distance than the thickness of the depending portion 130*a*, 131*a*, 132*a* and 133*a* of the retainer elements. The location of the elements 30–33 and 130–133 on the underside of members 28 or 128 may be varied as desired.

Each of the retainer elements 130–133 as seen in FIG. 11 is of like construction and only one element 130 will be described in detail. Element 130 includes a depending portion 130*a* which has an L-shaped cross-section configuration. Portion 130*a* depends from and is connected to a second portion 130*b* which in turn is affixed to the underside of the base member 128. The retainer elements are preferably formed from corrugated medium and the portions 130*a–b* thereof may be of multiple thicknesses. In certain instances, however, the retainer elements 130–133 may be preformed of molded pulp or molded foam plastic material.

Once the spacer means S′ is in proper position within the container interior, the depending portions of the retainer elements will snugly embrace peripheral segments of the upper surface of the accommodated product.

Figure 2:
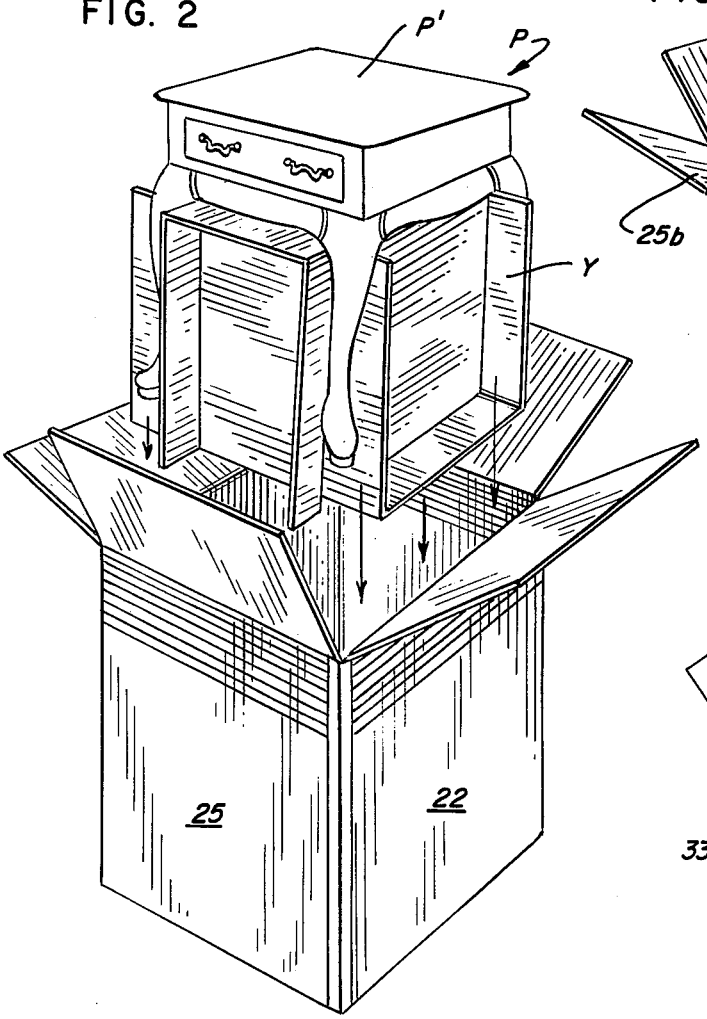
FIG. 2 is a perspective view of the container of FIG. 1 in a set-up condition ready to receive the product to be accommodated therein.

In packaging a product within the improved shipping unit, the following procedure should be practiced:

(a) The blank 21 should be set up as shown in FIG. 2 with the bottom closure flaps 22*a* 23*a*, 24*a* and 25*a* folded into an overlapping, closed relation and secured in such relation, and the top closure flaps disposed in an unfolded or open relation.

(b) In the event the product is a table with depending corner legs, the table may be positioned over a suitable saddle Y or the like, in a manner which is conventional in the packaging art, so that the table legs will not rest upon or be in direct contact with the bottom of the set-up container.

Figure 3:
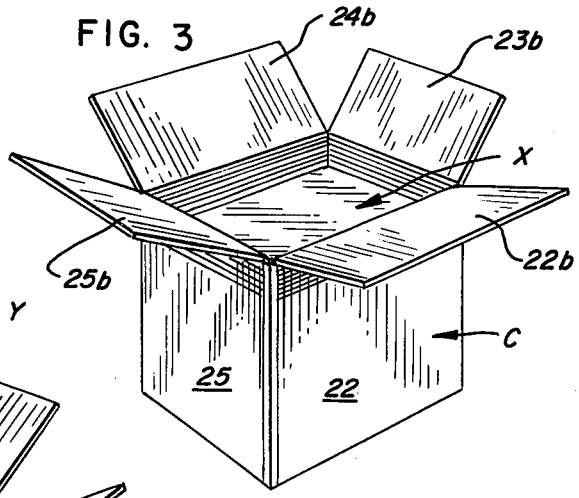
FIG. 3 is a perspective top view of the container of FIG. 2 showing the product positioned therein.

(c) The product along with its saddle, if that be the case, is loaded as a unit in an upright position into the container interior through the open top, so that the upper surface of the product can be observed through the open top, see FIG. 3. It should be noted that normally a furniture manufacturer, which manufactures a variety of custom grade tables and chests, will maintain an inventory of two or three different size container blanks which are of the same style but differing from one another in certain dimensions. Thus, in practicing the aforementioned steps, the size of container blank is selected which most closely approximates the dimensions of the product to be packaged.

(d) In placing the product within the container, it is preferred, but not essential, to position same so that one peripheral segment of the product upper surface is disposed adjacent to and centered with respect to one side wall of the container. Whatever the location of the product upper surface within the area, delimited by the container side walls, it is imperative that the retainer elements be arranged in a like manner. It will be noted in FIG. 3 that prior to the spacer means being placed in overlying relation with the product upper surface, a protective cloth X may be draped over the upper surface as shown. As the spacer means is being manually positioned over the product upper surface, the depending portions of either forms of retainer elements will snugly embrace peripheral segments of the product upper surface. As shown in FIG. 4, the depending portion of element 32 may be wedged between the periphery of the upper surface and the adjacent container side wall while the depending portions of elements 31 and 33 may be spaced inwardly a small amount from the periphery of the base member 28. As aforementioned, the base member 28 or 128 of the spacer means has a peripheral configuration corresponding substantially to the area delimited by the container side walls; thus, the container side walls will prevent lateral shifting of the spacer means as well as the product within the container.

(e) After the spacer means is in place, the operator slits downwardly from the tops of the foldlines defining the opposite vertical sides of the container side walls to corresponding transverse foldlines formed in the side walls and which are substantially coplanar with the exposed upper side of the spacer means. The top closure flap connected to a selected side wall is then folded inwardly so as to engage in overlying relation the exposed upper side of the spacer means. The same procedure is then followed with the opposite top closure flap and the remaining top closure flaps until the top of the container is closed and the product firmly held in place therein. The folded top closure flaps are then secured in place by suitable means such as staples or the like. Where staples are utilized they may penetrate the base member 28, thereby enhancing the stability of the spacer means with respect to the container side walls. Which of the corresponding foldlines of the sets of foldlines formed in the upper portions of the side walls will constitute the folding axes of the top closure flaps depends upon the elevation of the product upper surface within the container.

The aforenoted packaging procedure is simple, expeditious, and does not require an inordinate amount of dexterity on the part of the persons performing the operation. Furthermore, the manual effort required in performing the operation is minimal as compared to prior packaging procedures.

Because the container is capable of effectively accommodating products varying in height over a wide range, and the spacer means permits products varying in width and length over a wide range to be accommodated within a given container, one size container can be utilized for a wide range of products.

In a manufacturing operation wherein the products being produced are of the same general type (e.g, occasional tables, chests and the like) but vary to a considerable extent in height, width and length, the products can be segregated into two or three broad categories and then two or three size containers dimensioned to accommodate products within only a given category can be inventoried, thereby enabling the manufacturer to take advantage of the quantity discounts associated with buying a large number of standardized containers at one time. In addition, either partially, or fully formed spacer means can be inventoried in large quantities which are adapted for use with only the standardized container. The containers may be inventoried in blank form or in partially folded condition.

Thus, the improved shipping unit and method effectively overcome the serious and vexing problems which have previously beset manufacturers in their packaging operations without sacrificing the quality of the ultimate package or the protection afforded the accommodated product by said package.

I claim:

1. A shipping unit comprising an upright product having a substantially flat upper surface, the peripheral configuration of which may vary over a wide range; a container formed from a blank of sheet material accommodating the product therein, said container including a plurality of side walls having adjacent side walls connected by elongated upright foldlines, the upper portion of each side wall being provided with a plurality of vertically spaced foldlines extending across the entire width of said side wall and being disposed transversely of the upright foldlines, a bottom subtending the accommodated product, and top closure flaps connected to the side walls above the vertically spaced foldlines; and spacer means overlying the product upper surface, said spacer means including a multi-sided planar base member having a continuous, uninterrupted peripheral configuration conforming substantially to the area delimited by the container side walls and having the periphery of said base member in contact with the interior surface of said side walls, the peripheral configuration of said base member being larger than the range of peripheral configurations of the upper surface of the product accommodated within the container, and a plurality of stationary retainer elements affixed to and depending from the underside of the base member and snugly engaging peripheral segments of the product upper surface, the arrangement of said retainer elements effecting positioning, adjacent to and centrally of one side of said base member, at least a portion of each retainer element being positionable between a peripheral segment of the product upper surface and an adjacent container side wall, the upper side of the base member being in substantially coplanar relation with predetermined corresponding foldlines formed in the upper portions of said side walls and disposed beneath the connection between said top closure flaps and the side walls, the portions of the adjacent side walls disposed above the predetermined corresponding fold-lines being separated from one another by cuts aligned with the upright foldlines connecting the adjacent side walls and extending only downwardly from the top closure flap connections to the predetermined corresponding foldlines, whereby said top closure flaps and the associated cut portions of the side walls are folded about the predetermined corresponding foldlines and secured in overlying top closing relation with the upper side of the base member.

2. A method of loading in an upright position a product within a container, the latter having a closed bottom, side walls connected to one another by upright foldlines, top closure flaps foldably connected to the side walls, and a plurality of corresponding vertically spaced foldlines formed in the upper portions of the side walls and extending thereacross and intersecting the foldlines interconnecting the side walls, the product having a substantially flat upper surface wherein the peripheral configuration thereof is always smaller than and included within an area delimited by the container side walls; said method comprising inserting into the container through an open top thereof the product while in an upright position whereby the product upper surface is exposed through the open top; inserting through the container open top while in substantially parallel vertical alignment with the product upper surface and into engagement with the product upper surface, a planar member having a peripheral configuration corresponding substantially to the area delimited by the container side walls and having a plurality of relatively spaced stationary retainer elements depending from the underside of the planar member whereby corresponding portions of the retainer elements coact to snugly engage peripheral segments of the product upper surface while the periphery of the planar member slidably engages the interior surfaces of the container side walls and the exposed upper side of the planar member is spaced beneath the connections between the top closure flaps and the side walls and is substantially coplanar with the predetermined corresponding foldlines formed in the side walls, the arrangement of the depending retainer elements on the planar member effecting positioning of at least a peripheral segment of the product upper surface adjacent to but spaced from and substantially centrally of one container side wall; cutting segments of the upper portions of the side walls projecting above the exposed upper side of the planar member along the upright foldlines connecting the side walls and extending said cuts from the top closure flap connections to the predetermined corresponding foldlines formed in the side walls; and folding the top closure flaps and the associated cut segments of the side walls about the predetermined corresponding foldlines into overlying relation with the planar member and securing same in said overlying relation.

3. The method of claim 2 wherein the top closure flaps subsequent to being folded into overlying relation are stapled together and to portions of the planar member.

* * * * *